US007950184B2

(12) United States Patent
Flannery

(10) Patent No.: US 7,950,184 B2
(45) Date of Patent: May 31, 2011

(54) TWO-ACTION GATE REQUIRING TWO STEPS TO OPEN

(75) Inventor: Mark A Flannery, Longboat Key, FL (US)

(73) Assignee: Carlson Pet Products, Inc., Longboat Key, FL (US)

( * ) Notice: Subject to any disclaimer, the term of this patent is extended or adjusted under 35 U.S.C. 154(b) by 174 days.

(21) Appl. No.: 11/796,310

(22) Filed: Apr. 27, 2007

(65) Prior Publication Data

US 2008/0265233 A1 Oct. 30, 2008

(51) Int. Cl.
*E06B 9/01* (2006.01)

(52) U.S. Cl. ..... 49/57; 49/56; 49/50; 49/463

(58) Field of Classification Search ..... 49/50, 55, 49/56, 57, 463
See application file for complete search history.

(56) References Cited

U.S. PATENT DOCUMENTS

| | | | | |
|---|---|---|---|---|
| 4,611,431 | A * | 9/1986 | Lauro | 49/55 |
| 4,685,247 | A * | 8/1987 | Alam | 49/55 |
| 5,396,732 | A * | 3/1995 | Andersen | 49/55 |
| 6,446,395 | B2 * | 9/2002 | Rogers | 49/463 |
| 7,131,235 | B2 * | 11/2006 | Hicks | 49/55 |
| 2003/0005643 | A1 * | 1/2003 | Yang | 49/463 |
| 2003/0009945 | A1 * | 1/2003 | Cheng | 49/57 |
| 2003/0110704 | A1 * | 6/2003 | Cheng | 49/463 |
| 2004/0045222 | A1 * | 3/2004 | Hicks | 49/394 |
| 2007/0074453 | A1 * | 4/2007 | Flannery | 49/57 |

* cited by examiner

*Primary Examiner* — Gregory J. Strimbu

(57) ABSTRACT

To open a two-action gate, a sliding of a latch and a lifting of the gate to disengage a double stop is required. Performing one step without the other fails to open the gate. The gate is engaged in a frame which may in turn be engaged in a partition or doorway. Via a thumb tab, a portion of the latch can be slid out of the frame. Then the gate is lifted to lift the double stop up and clear of a lower portion of the frame such the gate is swingable. The gate is journaled to a vertically running frame member which serves as the swinging and sliding axis for the gate.

10 Claims, 2 Drawing Sheets

TWO-ACTION GATE REQUIRING TWO STEPS TO OPEN

FIELD OF THE INVENTION

The present invention relates generally to a gate, particularly to a safety gate for the inside of a residence, and specifically to such a safety gate that requires two steps to open.

BACKGROUND OF THE INVENTION

Children have boundless curiosity. Children can figure out how things work without books. For example, given time, a child can figure out how a gate works so that he or she can get to the other side or so that the dog can be let in. However, a child, especially a toddler, lacks physical strength.

Adults and teenagers are too busy and have little time. While a dog may move out of the master's path, a gate does not. A gate must be dealt with. If a gate is difficult to manage, then the gate will be removed or left open. If a gate is made easy to open and easy to close, then the chances are maximized that the adult or teenager will keep the gate closed to keep the children safe from falling down the stairs or to keep the dog in or out.

SUMMARY OF THE INVENTION

A feature of the present invention is a two-action gate that requires two steps to open. One step is a sliding of a latch with the thumb and the second step is a lifting of the gate with the remainder of the hand to free up a double stop while the latch is retained in an open position with the thumb. Thus, only one hand is required to manage the gate to make the gate easy to open and easy to close.

Another feature of the present invention is the weight of the gate. The gate is preferably relatively heavy from the standpoint of a toddler. A toddler may be able to manage the sliding of the latch. However, a toddler may not be able to manage to lift the gate so as to free up the double stop. The chances are fewer yet that the toddler can keep the latch open with one hand and lift the gate with the other hand. The material of the gate is preferably metal such as stainless steel.

Another feature of the present invention is that one control mechanism, the latch, for keeping the gate closed is positioned at an upper portion of the gate, and that another feature of the invention, the double stop, for keeping the gate closed is positioned at a lower portion of the gate such that the gate includes a two point connection when closed. When closed and pushed against, the gate remains square in its frame without any swaying or twisting.

An advantage of the present invention is that chances are maximized that a toddler cannot open the gate. The two-action or the two steps in combination provide difficulty for the child.

Another advantage of the present invention is that chances are maximized that older people in the household, such as adults and teenagers, will keep the gate closed. The two-action or two steps in combination are easily managed with one hand by a teenager or adult.

Another advantage of the present invention is that the gate is simple and inexpensive to manufacture.

DESCRIPTION

Figure 1:
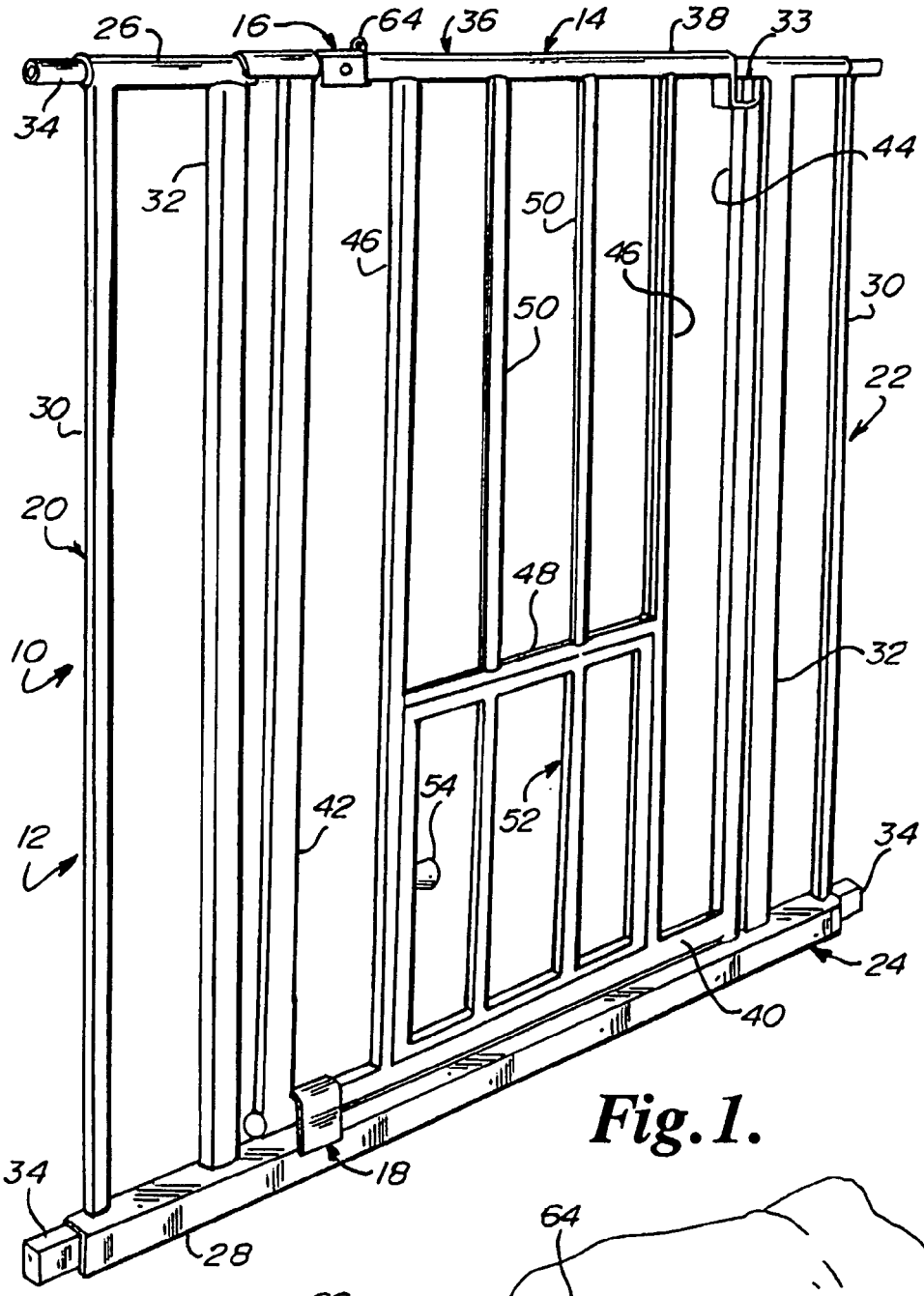
FIG. 1 is a perspective view of the present two-action gate in a closed position.

As shown in FIG. 1, the present gate apparatus is indicated in general by the reference number 10. Gate apparatus 10 includes a frame or outer frame 12, a gate 14, a latch mechanism 16, and a double stop 18.

Outer frame 12 generally includes a first side portion 20, a second side portion 22 and a lower portion 24. More specifically, each of the side portions 20, 22 of the outer frame 12 includes an upper structural member 26 that extends generally horizontally, a lower structural member or member portion 28 that extends generally horizontally, an outer or first structural member 30 that extends generally vertically and is engaged, such as by welding, to and between the members 26 and 28, and an inner or second structural member 32 that extends generally vertically and is engaged, such as by welding, to and between the members 26 and 28.

Outer frame 12 further includes, as part of the side section 22, an inner structural member 33 that extends generally vertically to and between the upper member 26 of side section 22 and lower member 28. Inner member 33 is referred to as the axis of the gate 14. Gate 14 is journaled upon inner member 33. Inner member 33 is fixed to lower member 28 via a pin and extends into upper member 26 via an opening in which inner member 33 frictionally fits.

Outer frame 12 is a compression frame. Outer frame 12 and gate 14 are disposed generally in a plane. Each of the side portions 20 and 22 includes an upper portion that includes the horizontally extending member 26. The upper portions, including members 26, are relatively drawable to and away from each other in such plane and such upper portions are biased away from each other such that, when the upper portions are drawn together, the outer frame 12 is compressed. This compression is maintained when male members 34 are engaged in female members in an exterior frame or apparatus, where such exterior frame or apparatus is part of a partition or barrier or where such exterior frame or apparatus extends from opposing walls or opposing portions of a door frame. Upper male members 34 extend from and are integral and one-piece with upper member 26. Lower male members 34 extend from and are one-piece with lower member 28. To provide such a compression, one or more of the side portions 20, 22 may be manufactured so as to be slightly oblique relative to the lower portion 24 of the outer frame 12. It should be noted that the four male members or four points of connection 34 may alternatively be female members, or the four points of connection may include a combination of male and female members.

Members 26 and 28 run generally parallel to each other when the outer frame 12 is compressed. Side portions 20 and 22 run generally parallel to each other when the outer frame 12 is compressed. Members 20 and 32 run generally parallel to each other when the frame is compressed or in an uncompressed state.

Upper horizontally extending member 26 is a cylindrical tube. Lower horizontally extending member 28 is tubular and in vertical section takes the form of a rectangle.

Outer or first vertical member 30 can be a tube or a rod. Inner or second vertical member 32 is a tube. Inner member or axis 33 can be a tube or rod.

Outer frame 12, including members 26, 28, 30, 32 and 33, is preferably formed of a metal. Of the metals, stainless steel is preferred. If desired, aluminum may be used.

Gate 14 includes its own frame 36. Gate frame 36 includes an upper structural member 38 extending generally horizontally, a lower structural member 40 extending generally horizontally, a first end vertical structural member 42 extending generally vertically and engaged between the upper and lower members 38 and 40, and a second end vertical structural member 44 extending generally vertically and engaged between the upper and lower members 38 and 40. Member 44 is journaled upon axis member 33 such that gate 14 can swing about the axis member 33. Member 44 is also axially slidable in the vertical direction along axis member 33 such that the gate 14 can be lifted up and set down in a vertical fashion.

Gate frame 36 further includes a pair of inner vertical structural members 46 extending generally vertically and engaged between the upper and lower members 38 and 40. Between the inner vertical structural members 46 is engaged a relatively short member 48 extending generally horizontally. Between the short member 48 and the upper member 36 is engaged two relatively short inner members 50 extending generally vertically. Pivotally engaged within short member 48, lower member 40 and side members 46 is a relatively small gate 52 having four vertically extending structural members and two horizontally extending structural members. Small gate 52 includes a spring biased latch 54 that cooperates with one side member 46 and is biased to the closed position. Small gate 52 is pivotally engaged via pin connectors to members 40, 48 at the end of the gate 52 that is opposite latch 54. Small gate 52 can swing out to either side of gate 14.

Gate frame 36, including structural members 38, 40, 42, 44, 46, 48, and 50 and further including small gate 52 and the structural members of the small gate 52, is preferably tubular. If desired, one or more of such structural members may be rods. Gate frame 36, including such structural members, is preferably formed of a metal. One preferred metal is stainless steel. If desired, aluminum may be used. Gate frame 36 is preferably relatively heavy for a toddler to lift vertically and relatively light for the teenager or adult to lift vertically.

Figure 5:
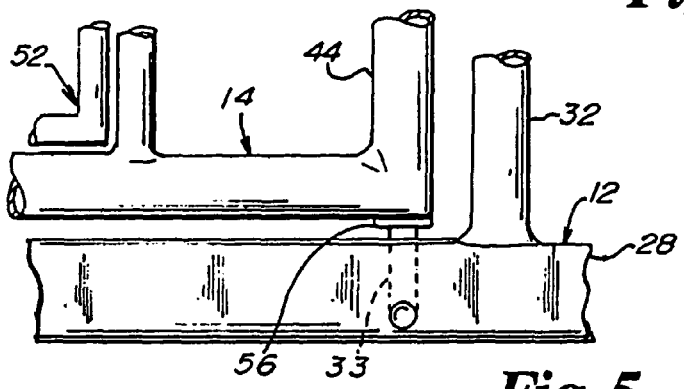
FIG. 5 is a side, detail view of the gate of FIG. 1 and shows the lower pivot connection of the gate.
Figure 8:
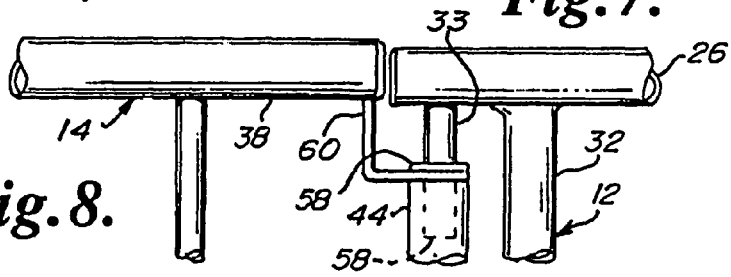
FIG. 8 is a side, detail view of the gate of FIG. 1 and shows the upper pivot connection of the gate.

FIGS. 5 and 8 show a swinging and lifting arrangement between the gate 14 and the outer frame 12. As shown in FIG. 5, member 33 is engaged to member 44 via a lower slippery collar 56 that permits both of a smooth swinging and lifting of gate 14 relative to member 33. Collar 56 is inset into a lower open end of member 44. As shown in FIG. 8, an upper slippery collar 58 is inset in an upper open end of member 44 to journal member 33 within member 44. Like with lower collar 56, such permits both of a smooth swinging and lifting of gate 14 relative to member 33. As further shown in FIG. 8, member 44 is engaged to upper member 38 of gate 14 via an angle bracket 60. Such a construction defines the upper limit to a vertical travel of the gate 14 relative to the frame 12. In other words, when the gate 14 is lifted, upper collar 58, preferably formed of a plastic material, abuts the undersurface of member 26 such that the upper collar 58 and undersurface act as stops relative to each other. A lower limit to the vertical travel of the gate 14 relative to the frame 12 is provided by a portion of the latch mechanism 16.

Figure 2:
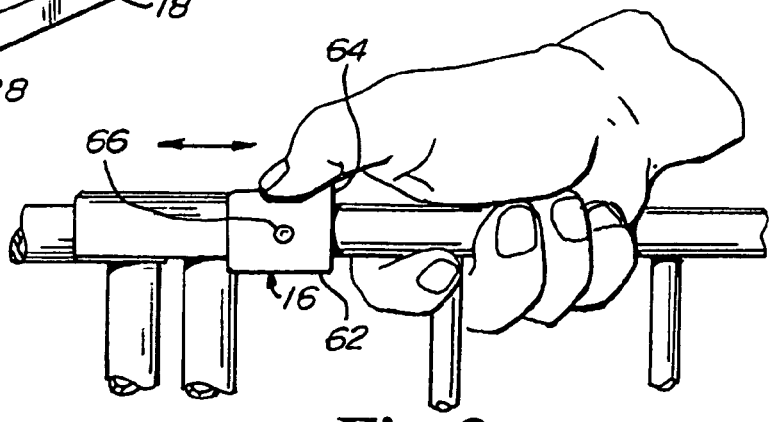
FIG. 2 is a side, detail view of the two-action gate of FIG. 1 and demonstrates how the latch is managed by the thumb and how the remainder of the hand may grasp the gate to lift the gate.
Figure 3:
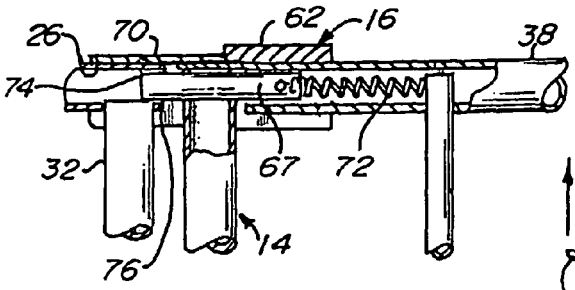
FIG. 3 is a side, detail, partial section view of the latch of FIG. 2 and shows the latch in a closed position.
Figure 4:
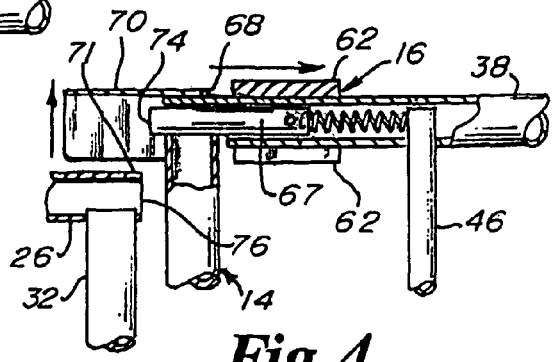
FIG. 4 is a side, detail, partial section view of the latch of FIG. 2, shows the latch in an open position, and further shows how the gate is lifted while the latch is in the open position.

The latch mechanism 16 is shown in FIGS. 2, 3 and 4. Latch mechanism 16 includes a generally U-shaped slide 62 slideably mounted on member 38 of gate 14. Slide 62 includes a thumb tab 64 extending from a rear end of the slide 62. Thumb tab 64 may be slid back by the thumb when the remaining portion of the hand, namely the fingers and/or palm of the hand, grab upper member 38 to lift the gate 14. Slide 62 is fixedly engaged with a pin connector 66 to a latch piece 67 that slides in member 38. Axially extending slots formed in both sides of member 38 receive the pin connector 66 and define how far the slide 62 and latch piece 67 can slide rearwardly, i.e., in the direction of axis member 33. An end 68 of a structural member extension 70 defines how far the slide 62 and latch piece 67 can slide forwardly, i.e., away from axis member 33. Structural member extension 70 is cylindrical and formed in the shape of a half-pipe such that extension 70 has an upper portion and a pair of side sections. Extension 70 is fixedly engaged to an upper half portion of member 38 and extends in the axial direction to bridge a gap over to member 26, the upper half-exterior of which forms a cylindrical seat 71 for seating extension 70. Extension 70 and seat 71 define the lower limit for the vertical travel of gate 14 when gate 14 is set down so as to engage the double stop 18 upon member 28 and, again, as shown in FIG. 8, collar 58 and the undersurface of member 26 of section 22 define the upper limit for the vertical travel of gate 14 relative to frame 12. When seated on seat 71, extension 70 maintains lower member 40 in a spaced apart and generally parallel relationship to member 28. When gate 14 is set down to one side of the frame 12 or to the other side of frame 12 such that the double stop 18 is not engaged, then the plastic lower collar 56 rides upon the upper surface of member 28 such the gate 14 swings easily on either of the sides of the frame 12 and such that the upper surface of member 28 defines the lower limit of vertical travel of gate 14 when the gate 14 is set down out of the plane of the frame 12.

Latch piece 67 is a tube. A rear portion of the latch piece 67 is engaged to one end of a coil spring 72 in member 38. The other end of the coil spring 72 is engaged within member 38, such as to a protruding end of member 46. A front portion 74 of latch piece 74 slides into and out of an inner open end or receiver 76 of member 26 of first side portion 20. When latch piece 67 is in open end or receiver 76, the gate 14 cannot be lifted relative to the frame 12. Nor can the gate 14 be swung relative to the frame 12 because of the nature of an inner tube (latch piece 67) engaged within an outer tube (member 26 of first side portion 20). The coil spring 72 biases the latch piece 67 to the closed position. This closed relationship is shown in FIG. 3. When latch piece 67 has been slid out of the open end 76, the front end 74 of latch piece 67 clears the open end 76 and the gate 14 is liftable relative to the frame 12. This open relationship is shown in FIG. 4, and this open relationship is relative to the latch, not necessarily relative to the gate 14, because the double stop 18 provides the next hurdle.

Figure 6:
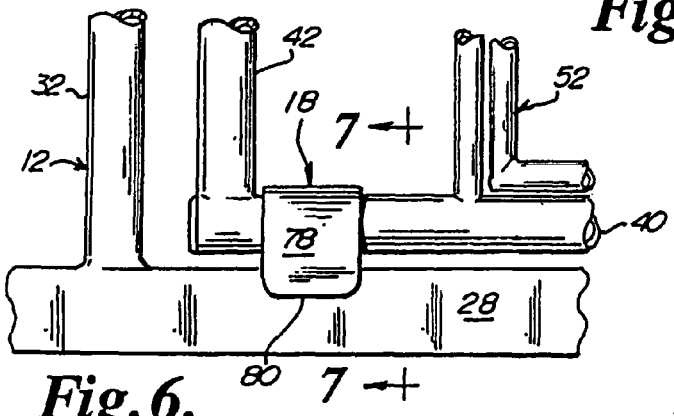
FIG. 6 is a side, detail view of the gate of FIG. 1 and shows the double stop engaged to the frame.
Figure 7:
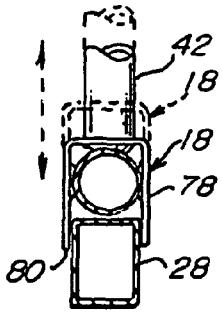
FIG. 7 is a section view of the double stop of FIG. 6 at lines 7-7 of FIG. 6 and shows the double stop engaged to the frame in solid lines and clear of the frame in phantom lines.

The double stop 18 is shown in FIGS. 1, 6 and 7. The double stop 18 is formed generally in the shape of an inverted U. The double stop 18 is mounted on lower member 40 and in a confronting relationship to upright end member 42. Stop 18 includes a pair of rigid sides 78 depending downwardly, with each of the sides 78 having a lower end 80. When extension 70 is seated on seat 71 of member 26, each of the sides 78 of double stop 18 confronts a side of member 28. After latch piece 67 has been disengaged from open end 76 and after gate 14 has been sufficiently lifted, each of the ends 80 of double stop 18 can clear the upper surface of member 28, thereby allowing a swinging of the gate 14 to either of the sides of the frame 12.

In operation, to open the gate 14, the hand grabs upper member 38 with the thumb positioned on tab 64 of slide 62, as shown in FIG. 2. Then the thumb slides the slide 62 rearwardly to draw latch piece 67 out of the open end 74 of upper member 26. Then the gate 14 is lifted until the double stop 18 clears the lower member 24 of the frame 12, whereupon the gate 14 is swingable to either side of the frame 12. Once on either side of the frame 12, the gate 14 may be lowered, and, in such a state, the gate 14 is swingable on only one side of the frame 12, as the double stop 18, by virtue of hitting member 28, prevents a swing through of the gate 14 to the other side of the frame 12. To close the gate 14, the gate 14 is lifted so that the double stop 18 clears member 28 and so that the double stop 18 is positioned over and aligned with member 28. Then the slide 62 is drawn rearwardly with the thumb such that the front end 74 of the latch piece 67 can clear the open end 76 of member 26 as the gate 14 is lowered, whereupon the gate 14 is lowered until the extension 70 is seated upon seat 71, whereupon the thumb releases the slide 62, and whereupon the front end 74 of the latch piece 67 automatically returns into the open end 76 of member 26 such that the gate 14 is closed.

It should be noted that latch mechanism 16 and double stop 18 are generally aligned vertically. Such provides a two-point connection and minimizes any swaying or tilting of the gate 14 relative to the outer frame 12 such as when a toddler pushes upon the gate 14 when closed.

It should further be noted that, while the double stop 18 holds the gate 14 against a force applied perpendicular to the plane of the gate 14, latch mechanism 16 also holds the gate 14 true against a force applied perpendicular to the plane of the gate. Latch mechanism 16 does this in two ways. First, extension 70, formed in the shape of a half-pipe, includes side sections that confront member 26 of first side portion 20 about side sections of member 26. This provides resistance against such a perpendicular force. Second, latch piece 67 is an inner tube that is received within an outer tube, i.e., member 26. This also provides resistance against such a perpendicular force, as well as providing resistance against a lifting force. In other words, the extension 70 maintains member 40 in a spaced apart and parallel relationship with member 28 to provide a lower limit to vertical travel of gate 14 and further prevents a swinging of the gate 14 when the extension 70 is seated on seat 71, as side sections of the cylindrical extension 70 are seated about side sections of tubular seat 71.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A two-action gate apparatus comprising:

a) a frame, with the frame comprising a lower portion and first and second side frame portions, wherein each of the first and second side frame portions of the frame includes an upper member that extends generally horizontally, a first member that extends generally vertically, and a second member that extends generally vertically, and the lower portion of the frame comprising a lower member that extends generally horizontally between the first and second side frame portions;

b) a gate disposed between the first and second side frame portions of the frame, with the gate pivotally engaged to the frame about a generally vertical axis such that the gate is swingable relative to the frame, with the gate further being axially slideable along said generally vertical axis such that the gate is liftable from a confronting position with the lower member of the frame, with the gate comprising:

i) an upper structural member extending generally horizontally, a lower structural member extending generally horizontally, and generally vertical structural members engaged with and extending generally vertically between the upper and lower structural members;

ii) a latch mechanism having a latch piece slideable into and out of said first side frame portion of the frame, with the latch mechanism preventing the gate from being lifted relative to the frame when the latch piece has been slid into said first side frame portion of the frame, and with the gate being liftable relative to the frame axially along said axis when the latch piece has been slid out of said first side frame portion of the frame; and iii) a stop having sides, with the stop preventing the gate from being swung about said axis in either direction when the sides of the stop confront two faces of the lower member of the frame such that during opening and closing of the gate the gate must be lifted relative to the frame along the axis such that said stop clears said lower member of the frame;

c) wherein the latch mechanism further comprises a thumb tab slideably mounted on the upper structural member of the gate, said latch piece fixedly engaged to the thumb tab, said latch piece disposed in the upper structural member such that when the thumb tab is slid the latch piece slides, and the latch piece being biased toward sliding into the first side frame portion such that the latch piece automatically slides into the first side frame portion when the gate is closed and the thumb tab is released from a retracted position;

d) wherein the gate and frame are disposed in a plane when the gate is closed, wherein the upper members of the first and second side frame portions of the frame are relatively drawable to and away from each other in said plane, wherein a spacing between the first side frame portion and the second side frame portion is greater adjacent said upper members of the frame than adjacent said lower member of the frame to provide a compression frame;

e) wherein the upper structural member comprises an extension extending generally in an axial direction of the upper structural member, wherein the extension comprises an upper portion and a pair of side sections, wherein the upper member of said first side frame portion of the frame comprises a seat for seating the extension thereon, wherein the seat includes side sections, wherein, when seated, the upper portion of the extension rests on said seat and maintains the lower structural member in a spaced apart and parallel relationship with the lower member of the frame such that a lower limit to the vertical sliding of the gate along said axis is provided, and wherein, when seated, said side sections of the extension confront said side sections of said seat such that swinging of the gate is prevented; and f) wherein said extension is a cylindrically shaped a half-pipe and wherein said seat comprises a cylindrical seat for seating said extension thereon.

2. The two-action gate apparatus of claim 1, wherein said latch piece comprises a first tube portion slideable into and out of said first side frame portion of the frame, with the first tube portion being disposed in the upper structural member and axially slideable in the upper structural member, and wherein said frame further comprises a receiver in said first side frame portion of the frame, with said receiver comprising a second tube portion, and with the first tube portion being axially slideable into the second tube portion.

3. The two-action gate apparatus of claim 1, wherein one of the generally vertical structural members of the gate includes an upper end, wherein said second side frame portion of the frame includes an undersurface, and wherein said undersurface confronts and stops vertical movement of the upper end when the gate is lifted along the axis to provide an upper limit to the vertical sliding of said gate along said axis.

4. The two-action gate apparatus of claim 1, wherein one of the generally vertical structural members of the gate comprises a tube, wherein said second side frame portion of the frame includes a generally vertical support, wherein the generally vertical support is journaled in the tube to provide for swinging and lifting of the gate, and wherein the tube and generally vertical support are on said axis.

5. The two-action gate apparatus of claim 1, wherein each of the first and second side frame portions comprises one of a male and female member such that the two-action gate apparatus can make up a portion of a partition.

6. The two-action gate apparatus of claim 1, wherein said latch mechanism and stop are aligned generally vertically.

7. The two-action gate apparatus of claim 1, wherein said gate includes two end portions, with one of the end portions having said axis, and with the other of said end portions having the latch mechanism and stop.

8. The two-action gate apparatus of claim 1, wherein the frame has a first side and a second side, and wherein, said gate is swingable to either said first side or said second side.

9. A two-action gate apparatus comprising:

a) a frame, with the frame comprising a lower portion and first and second side frame portions, wherein each of the first and second side frame portions of the frame includes an upper member that extends generally horizontally, a first member that extends generally vertically, and a second member that extends generally vertically, and the lower portion of the frame comprising a lower member that extends generally horizontally between the first and second side frame portions;

b) a gate disposed between the first and second side frame portions of the frame, with the gate pivotally engaged to the frame about a generally vertical axis such that the gate is swingable relative to the frame, with the gate further being axially slideable along said generally vertical axis such that the gate is liftable from a confronting position with the lower member of the frame, with the gate comprising:

i) an upper structural member extending generally horizontally, a lower structural member extending generally horizontally, and generally vertical structural members engaged with and extending generally vertically between the upper and lower structural members;

ii) a latch mechanism having a latch piece slideable into and out of said first side frame portion of the frame, with the latch mechanism preventing the gate from being lifted relative to the frame when the latch piece has been slid into said first side frame portion of the frame, and with the gate being liftable relative to the frame axially along said axis when the latch piece has been slid out of said first side frame portion of the frame; and iii) a stop having sides, with the stop preventing the gate from being swung about said axis in either direction when the sides of the stop confront two faces of the lower member of the frame such that during opening and closing of the gate the gate must be lifted relative to the frame along the axis such that said stop clears said lower member of the frame;

c) wherein the latch mechanism further comprises a thumb tab slideably mounted on the upper structural member of the gate, said latch piece fixedly engaged to the thumb tab, said latch piece disposed in the upper structural member such that when the thumb tab is slid the latch piece slides, the latch piece being biased toward sliding into the first side frame portion such that the latch piece automatically slides into the first side frame portion when the gate is closed and the thumb tab is released from a retracted position;

d) wherein the gate and frame are disposed in a plane when the gate is closed, wherein the upper members of the first and second side frame portions of the frame are relatively drawable to and away from each other in said plane, wherein a spacing between the first side frame portion and the second side frame portion is greater adjacent said upper members of the frame than adjacent said lower member of the frame to provide a compression frame;

e) wherein said latch piece comprises a first tube portion slideable into and out of said first side frame portion of the frame, with the first tube portion being disposed in the upper structural member and axially slideable in the upper structural member, and wherein said frame further comprises a receiver in said first side frame portion of the frame, with said receiver comprising a second tube portion, and with the first tube portion being axially slideable into the second tube portion;

f) wherein the frame has a first side and a second side, and wherein, said gate is swingable to either said first side or said second side;

g) wherein the upper structural member comprises an extension extending generally in an axial direction of the upper structural member, wherein the extension comprises an upper portion and a pair of side sections, wherein the upper member of said first side frame portion of the frame comprises a seat for seating the extension thereon, wherein the seat includes side sections, wherein, when seated, the upper portion of the extension rests on said seat and maintains the lower structural member in a spaced apart and parallel relationship with the lower member of the frame such that a lower limit to the vertical sliding of the gate along said axis is provided, and wherein, when seated, said side sections of the extension confront said side sections of said seat such that swinging of the gate is prevented; and h) wherein said extension is a cylindrically shaped a half-pipe and wherein said seat comprises a cylindrical seat for seating said extension thereon.

10. A two-action gate apparatus comprising:

a) a frame, with the frame comprising a lower portion and first and second side frame portions, wherein each of the first and second side frame portions of the frame includes an upper member that extends generally horizontally, a first member that extends generally vertically, and a second member that extends generally vertically, and the lower portion of the frame comprising a lower member that extends generally horizontally between the first and second side frame portions;

b) a gate disposed between the first and second side frame portions of the frame, with the gate pivotally engaged to the frame about a generally vertical axis such that the gate is swingable relative to the frame, with the gate further being axially slideable along said generally vertical axis such that the gate is liftable from a confronting position with the lower member of the frame, with the gate comprising:

i) an upper structural member extending generally horizontally, a lower structural member extending generally horizontally, and generally vertical structural members engaged with and extending generally vertically between the upper and lower structural members;

ii) a latch mechanism having a latch piece slideable into and out of said first side frame portion of the frame, with the latch mechanism preventing the gate from being lifted relative to the frame when the latch piece has been slid into said first side frame portion of the frame, and with the gate being liftable relative to the frame axially along said axis when the latch piece has been slid out of said first side frame portion of the frame; and iii) a stop having sides, with the stop preventing the gate from being swung about said axis in either direction when the sides of the stop confront two faces of the lower member of the frame such that during opening and closing of the gate the gate must be lifted relative to the frame along the axis such that said stop clears said lower member of the frame;

c) wherein the latch mechanism further comprises a thumb tab slideably mounted on the upper structural member of the gate, said latch piece fixedly engaged to the thumb tab, said latch piece disposed in the upper structural member such that when the thumb tab is slid the latch piece slides, and the latch piece being biased toward sliding into the first side frame portion such that the latch piece automatically slides into the first side frame portion when the gate is closed and the thumb tab is released from a retracted position;

d) wherein the gate and frame are disposed in a plane when the gate is closed, wherein the upper members of the first and second side frame portions of the frame are relatively drawable to and away from each other in said plane, wherein a spacing between the first side frame portion and the second side frame portion is greater adjacent said upper members of the frame than adjacent said lower member of the frame to provide a compression frame;

e) wherein said latch piece comprises a first tube portion slideable into and out of said first side frame portion of the frame, with the first tube portion being disposed in the upper structural member and axially slideable in the upper structural member, and wherein said frame further comprises a receiver in said first side frame portion of the frame, with said receiver comprising a second tube portion, and with the first tube portion being axially slideable into the second tube portion;

f) wherein the frame has a first side and a second side, and wherein, said gate is swingable to either said first side or said second side;

g) wherein one of the generally vertical structural members of the gate includes an upper end, wherein said second side frame portion of the frame includes an undersurface, and wherein said undersurface confronts and stops vertical movement of the upper end when the gate is lifted along the axis to provide an upper limit to the vertical sliding of said gate along said axis;

h) wherein said one of the generally vertical structural members of the gate comprises a tube, wherein said second side frame portion of the frame includes a generally vertical support, wherein the generally vertical support is journaled in the tube to provide for swinging and lifting of the gate, and wherein the tube and generally vertical support are on said axis;

i) wherein the upper structural member comprises an extension extending generally in an axial direction of the upper structural member, wherein the extension comprises an upper portion and a pair of side sections, wherein the upper member of said first side frame portion of the frame comprises a seat for seating the extension thereon, wherein the seat includes side sections, wherein, when seated, the upper portion of the extension rests on said seat and maintains the lower structural member in a spaced apart and parallel relationship with the lower member of the frame such that a lower limit to the vertical sliding of the gate along said axis is provided, and wherein, when seated, said side sections of the extension confront said side sections of said seat such that swinging of the gate is prevented; and j) wherein said extension is a cylindrically shaped a half-pipe and wherein said seat comprises a cylindrical seat for seating said extension thereon.

* * * * *